US008230540B1

(12) United States Patent
Nelson

(10) Patent No.: US 8,230,540 B1
(45) Date of Patent: Jul. 31, 2012

(54) CORDLESS SWEEPER

(76) Inventor: Marc O. Nelson, Maple Grove, MN (US)

( * ) Notice: Subject to any disclaimer, the term of this patent is extended or adjusted under 35 U.S.C. 154(b) by 1134 days.

(21) Appl. No.: 12/148,941

(22) Filed: Apr. 23, 2008

Related U.S. Application Data

(60) Provisional application No. 60/925,954, filed on Apr. 24, 2007.

(51) Int. Cl.
*A47L 11/33* (2006.01)

(52) U.S. Cl. ..... 15/41.1; 15/83

(58) Field of Classification Search ..... 15/41.1, 15/42, 83
See application file for complete search history.

(56) References Cited

U.S. PATENT DOCUMENTS

| | | | | |
|---|---|---|---|---|
| D46,634 | S | 11/1914 | Ferguson | |
| D46,800 | S | 12/1914 | Boyer | |
| 1,129,118 | A * | 2/1915 | Pereira | 15/42 |
| D47,020 | S | 3/1915 | Ferguson | |
| D50,310 | S | 2/1917 | Krantz | |
| 2,101,133 | A | 12/1937 | Dilliard | |
| 3,184,775 | A | 5/1965 | Downey et al. | |
| 3,460,188 | A | 8/1969 | Boyd | |
| 3,906,585 | A * | 9/1975 | Mattsson | 15/349 |
| 3,978,539 | A | 9/1976 | Yonkers | |
| 4,042,994 | A * | 8/1977 | Sassaman et al. | 15/83 |
| 4,219,897 | A | 9/1980 | Leibscher et al. | |
| 4,445,245 | A | 5/1984 | Lu | |
| 4,701,969 | A * | 10/1987 | Berfield et al. | 15/79.1 |
| 4,709,436 | A | 12/1987 | Berfield et al. | |
| 4,974,283 | A | 12/1990 | Holsten et al. | |
| 4,979,260 | A | 12/1990 | Holsten et al. | |
| 5,309,597 | A | 5/1994 | Wymore | |
| 5,500,979 | A | 3/1996 | Worwag | |
| 5,664,276 | A * | 9/1997 | Arias | 15/42 |
| 5,896,611 | A | 4/1999 | Haaga | |
| 5,920,939 | A * | 7/1999 | Worwag | 15/41.1 |
| 6,436,160 | B1 | 8/2002 | Stephens et al. | |
| 6,553,600 | B2 * | 4/2003 | Fischer | 15/41.1 |
| 7,665,172 | B1 * | 2/2010 | Tran et al. | 15/41.1 |
| 2007/0089250 | A1 * | 4/2007 | Hsiao | 15/42 |

FOREIGN PATENT DOCUMENTS

EP 0 050 470 * 4/1982

* cited by examiner

*Primary Examiner* — Randall Chin
(74) *Attorney, Agent, or Firm* — Richard John Bartz

(57) ABSTRACT

A floor and carpet sweeper has a pair of side-by-side brush assemblies rotated in opposite rotational directions with a battery operated electric motor operable to pickup dust, dirt and debris materials from a surface and deposit the materials into a replacement filter box.

20 Claims, 8 Drawing Sheets

CORDLESS SWEEPER

CROSS REFERENCE TO RELATED APPLICATION

This application claims the benefit of U.S. Provisional Patent Application Ser. No. 60/925,954 filed Apr. 24, 2007.

BACKGROUND OF THE INVENTION

Conventional surface cleaning machines have power driven brushes and use vacuum air pressure to pickup dust and dirt from floors and carpets and transfer the dust and dirt with air into porous bags. Electric motors connected with wire cords to electric outlets drive fans to establish vacuum air flow that carry dust and dirt to the bags. These cleaning machines are used in commercial, office and retail stores during off hours to clean floors and carpets. A combined sweeper and vacuum cleaning having an electric carpet sweeper with one rotary brush driven by an electric motor wired to a battery is disclosed by D. F. Downey et al in U.S. Pat. No. 3,184,775. Dust and dirt is picked up by the brush and transferred through a handle tube and hose to the inlet of a vacuum cleaner. The vacuum cleaner draws air through the sweeper to transport dust and dirt to the vacuum cleaner.

SUMMARY OF THE INVENTION

The sweeper of the invention is a surface cleaning machine used for day cleaning in areas when cords of electric vacuum create a safety hazard. The sweeper has an electric motor powered by a battery to rotate dirt and debris pickup brush assemblies that collect and transfer dirt and debris into a filter box. The filter box is removable from the machine whereby the dirt and debris can be removed from the filter box and discarded or a new filter box can be placed into the cleaning machine. The sweeper is quiet and unobtrusive in operation allowing it to be used to pickup dirt and debris from carpets and bare floors without disturbing customers and coworkers. The sweeper can be used a number of times during normal business hours in high traffic areas, such as entry mats, retail stores and restaurant floors which is an advantage over cord vacuum cleaners that can only be used during off hours.

The sweeper is a floor, carpet and mat cleaning machine that is manually used by a work person to pickup materials, such as dirt, debris and moisture and deposit these materials in a container. The sweeper has a frame movably supported on a surface with a pair of rear wheels and a transverse front roller wheel. An upright handle joined to the frame is used by a work person to move the sweeper along the surface. A pair of side-by-side brush assemblies are rotatably mounted on the frame in front of the transverse roller wheel. Each brush assembly has two rows of helical radial projections that engage the surface to pickup dirt and debris and transfer the dirt and debris into the container. A drive mechanism including an electric motor wired to a battery and a power transmission operates to rotate the brush assemblies in opposite rotational directions to pickup dirt and debris from the surface and transfer it to the container. The container is a box having a front opening to a chamber for holding dirt and debris. The box has a wall with openings to allow air to flow through a filter from the chamber to the surrounding environment.

DETAILED DESCRIPTION OF THE INVENTION

Figure 1:
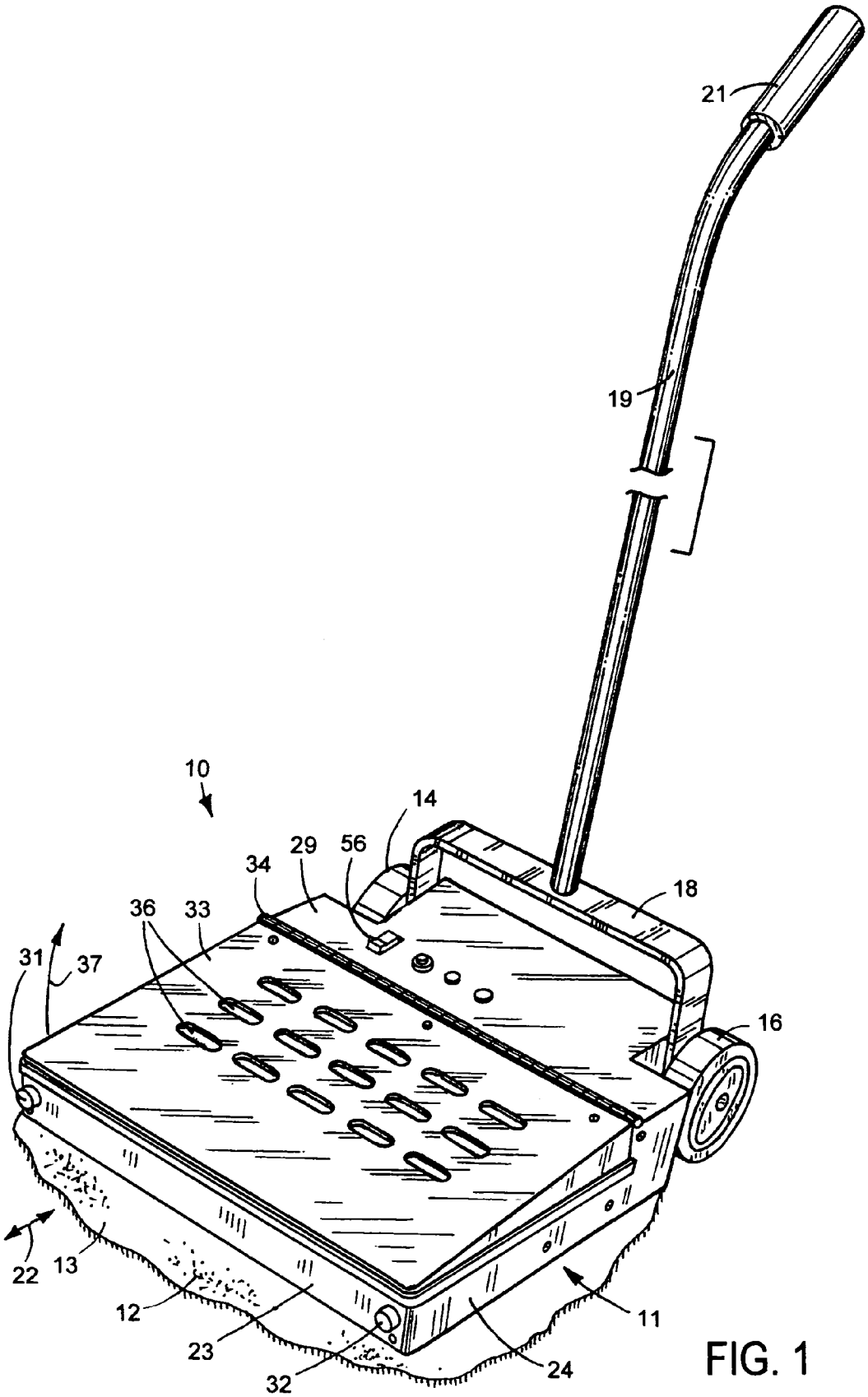
FIG. 1 is a perspective view of the cordless sweeper of the invention.
Figure 2:
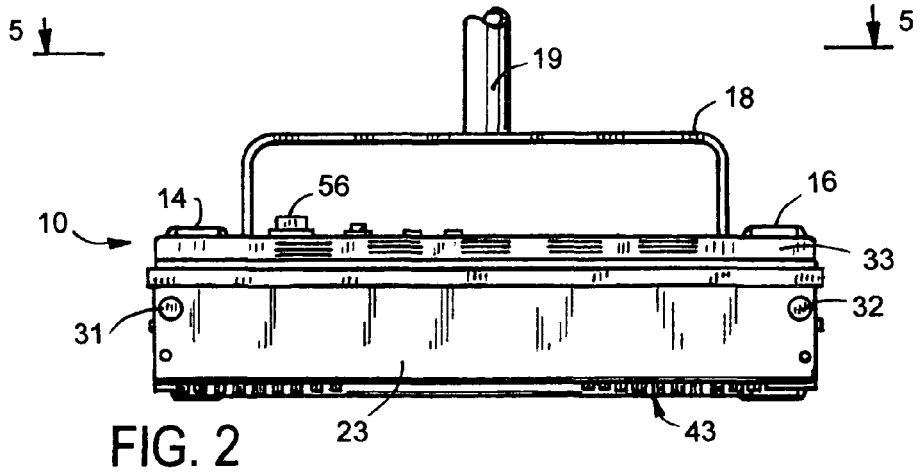
FIG. 2 is a front elevational view of the cordless sweeper of FIG. 1 with the upper section of the handle omitted.
Figure 3:
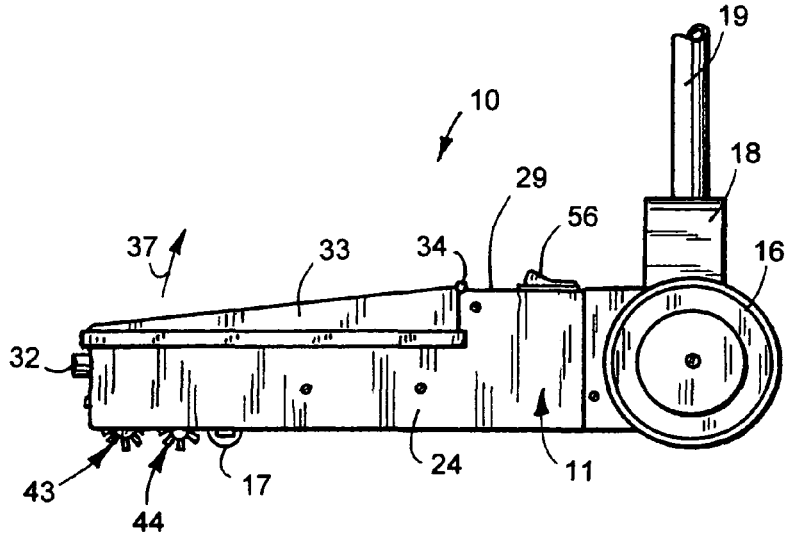
FIG. 3 is a side elevational view of the cordless sweeper of FIG. 1 with the upper section of the handle omitted.
Figure 4:
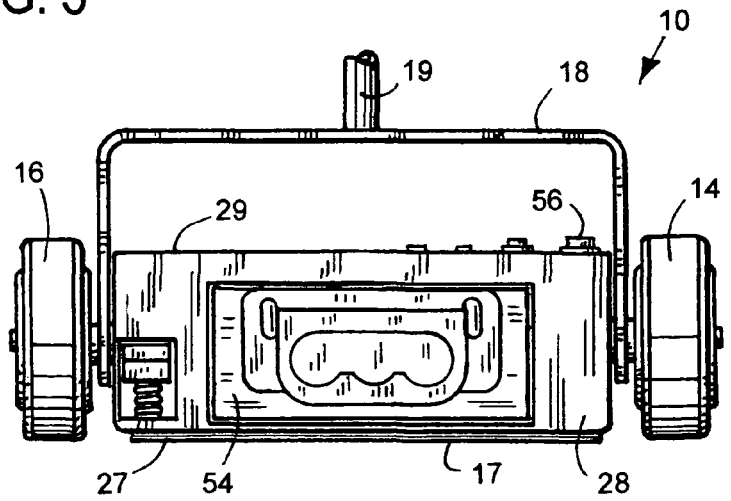
FIG. 4 is a rear elevational view of the cordless sweeper of FIG. 1 with the upper section of the handle omitted.
Figure 5:
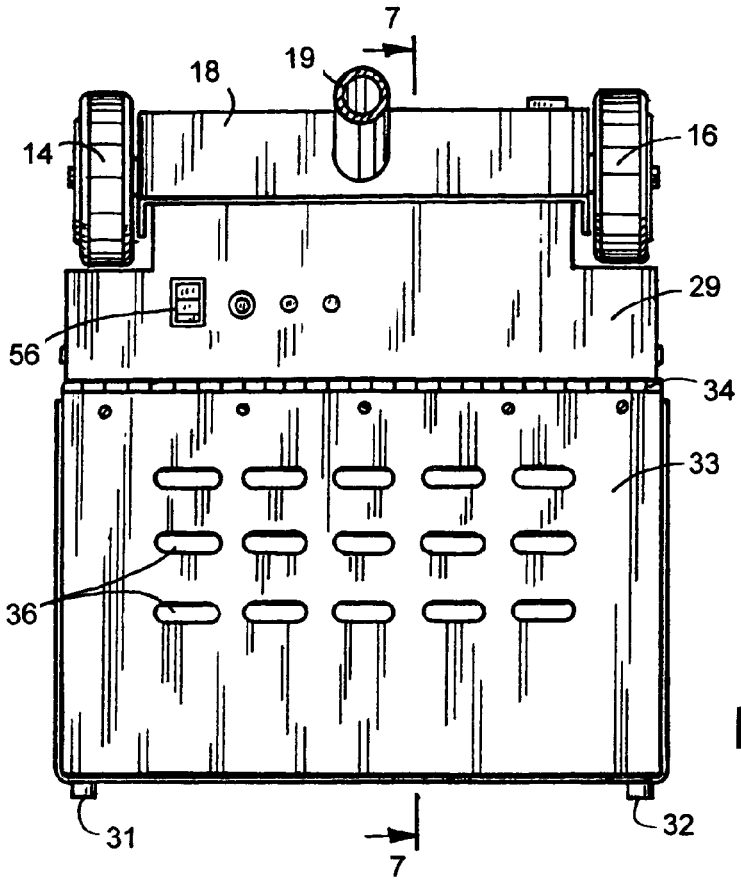
FIG. 5 is a sectional view taken along the line 5-5 of FIG. 2.

In the following detailed description of the cordless sweeper, reference is made to the accompanying drawing that form a part hereof, and in which are shown, by way of illustration, specific embodiments in which the invention may be practiced. It is to be understood that other embodiments may be utilized and structural changes may be made without departing from the scope of the present invention.

Cordless sweeper 10, shown in FIGS. 1 to 6, is a floor and mat cleaning machine that is manually operated by a work person to pickup dirt, debris and moisture 12 from a surface 13. Sweeper 10 has a frame 11 movably supported on surface 13 with a pair of rear wheels 14 and 16 and a transverse front roller wheel 17. An inverted U-shaped member or yoke 18 mounted on the axles of wheels 14 and 16 is connected to an upright cylindrical handle 19. A hand grip 21 extended over the upper end of handle 19 is used by a person to move sweeper 10 in sequential opposite directions, shown by arrow 22 to pickup dirt and debris 12 from surface 13 and deposit the dirt and debris into a filter box 38.

Frame 11 comprises a transverse front wall 23 joined to rearwardly extended side walls 24 and 26. A flat horizontal bottom wall 27 is connected to the lower edges of side walls 24 and 26. A rear wall 28 extended between rear wheels 14 and 16 is joined to a top wall 29 which is also connected to side walls 24 and 26. A pair of cylindrical bumpers or cushions 31 and 32 are mounted on front wall 23 to inhibit frame 11 from hitting walls and upright objects. As shown in FIGS. 1, 2, 3 and 5, a cover 33 extended over the space between side walls 24 and 26 is connected to top wall 29 with a transverse hinge 34. Cover 33 has three rows of air vents slots or openings to allow air to flow from a filter box 38 to atmosphere. Cover 33 is pivoted upward, shown by arrow 37 to provide access to filter box 38 and allow filter box 38 to be removed from sweeper 10 for disposal of dirt and debris or replacement with another filter box.

Figure 6:
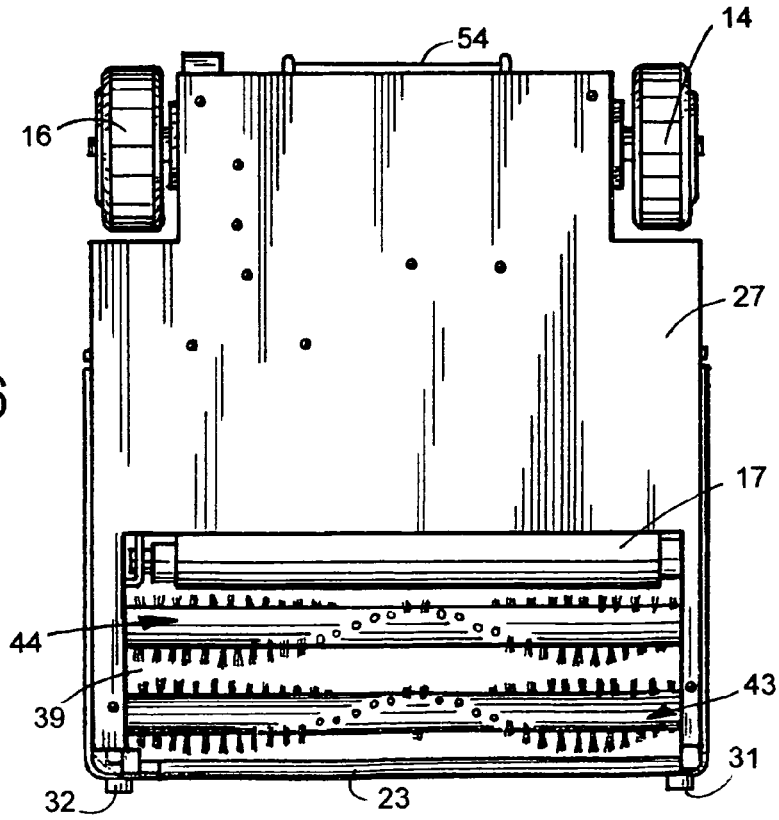
FIG. 6 is a bottom plan view of the cordless sweeper of FIG. 1.
Figure 8:
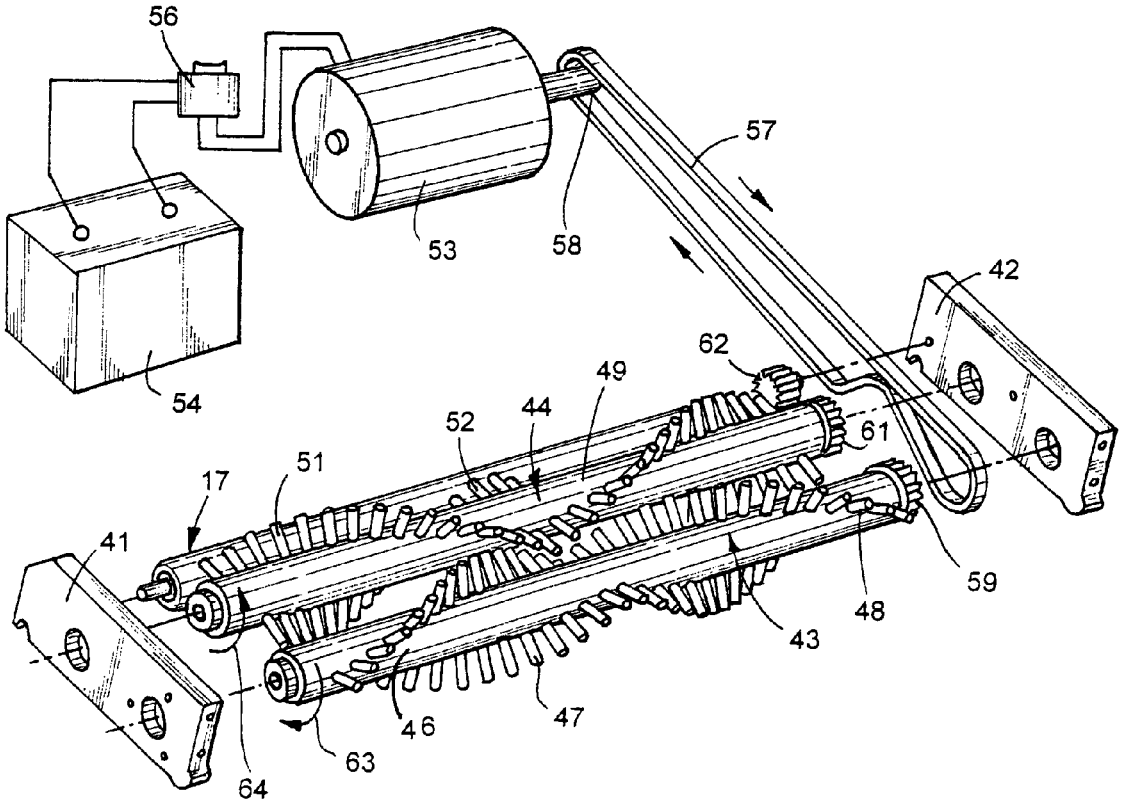
FIG. 8 is a perspective view of the material pickup brush assemblies and front roller wheel drivably connected to an electric motor wired to a battery.
Figure 9:
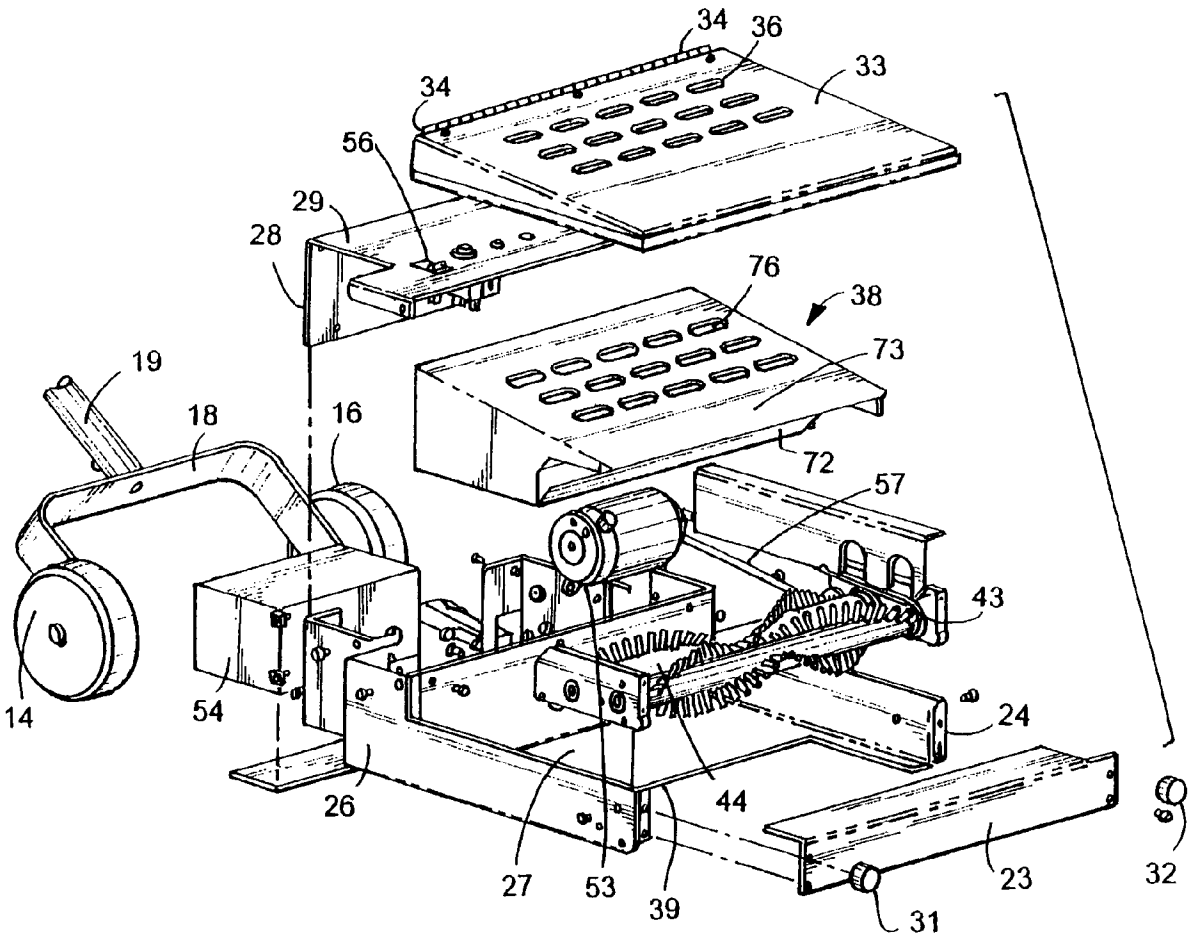
FIG. 9 is an exploded perspective view of the cordless sweeper of FIG. 1.
Figure 10:
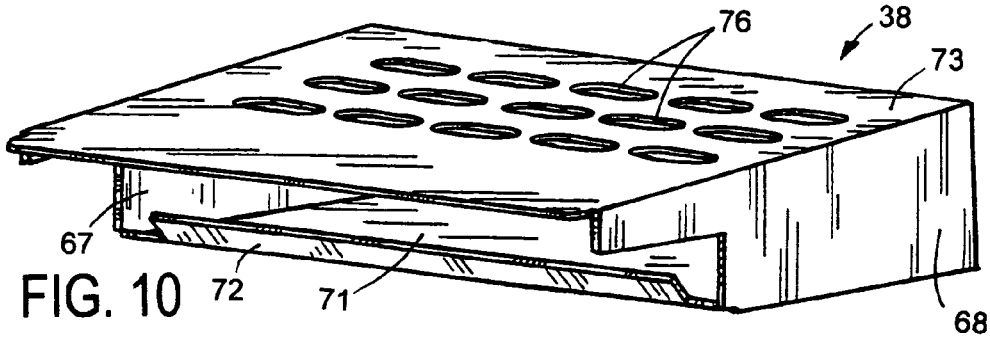
FIG. 10 is a perspective view of the dirt and debris filter box of the cordless sweeper of FIG. 1.
Figure 11:
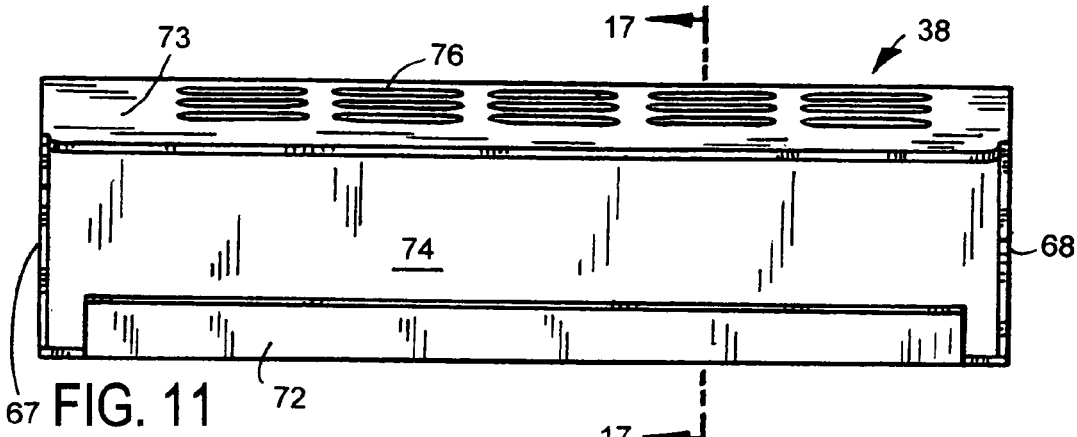
FIG. 11 is a front elevational view of FIG. 10.
Figure 12:
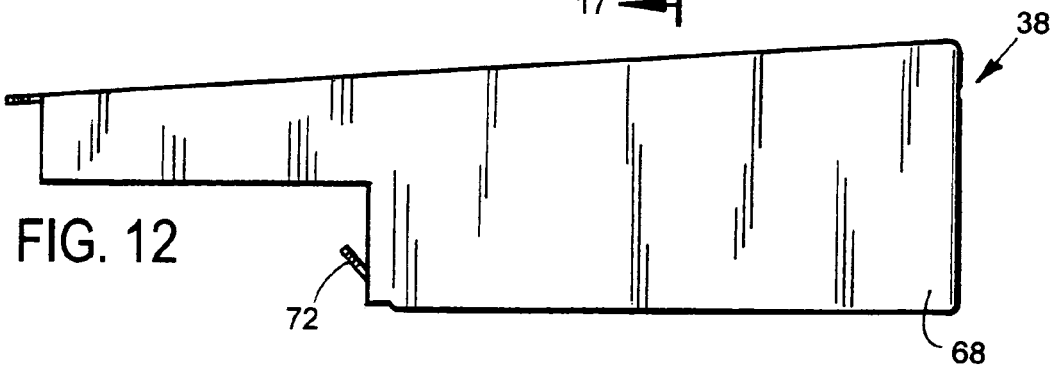
FIG. 12 is a side elevational view of the right side of FIG. 10.
Figure 13:
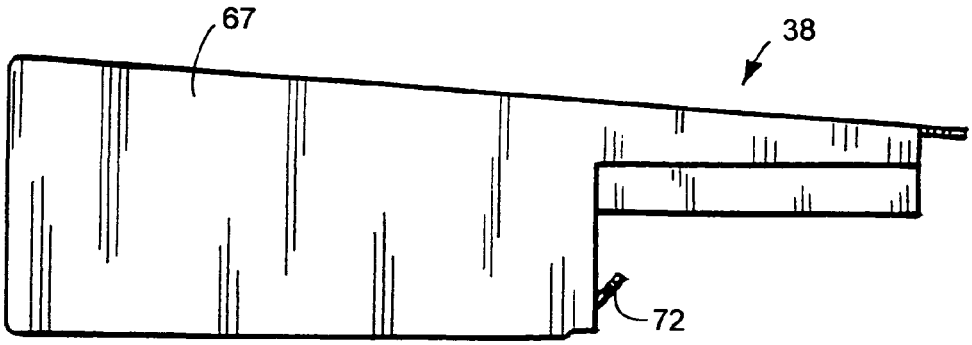
FIG. 13 is a side elevational view of the left side of FIG. 10.
Figure 14:
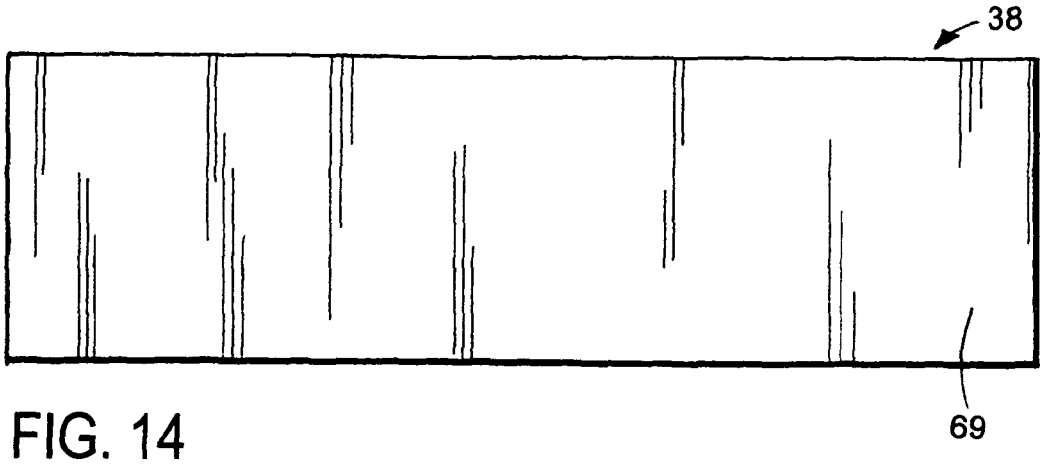
FIG. 14 is a rear elevational view of FIG. 10.
Figure 15:
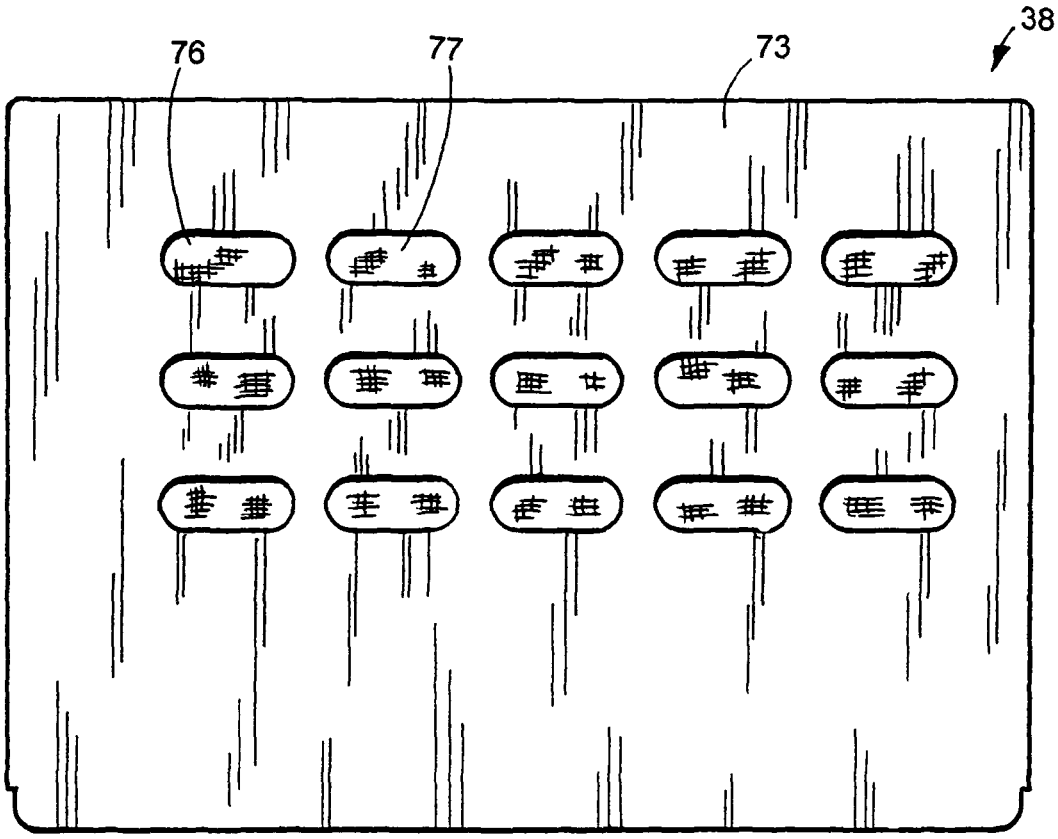
FIG. 15 is a top plan view of FIG. 10.
Figure 16:
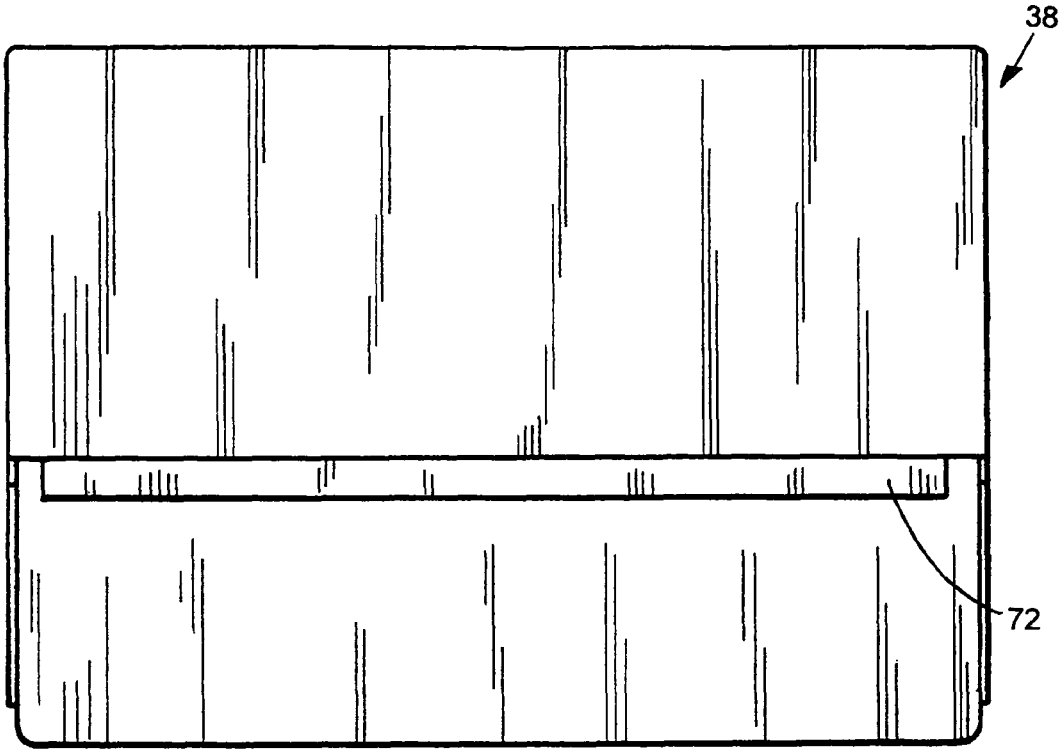
FIG. 16 is a bottom plan view of FIG. 10.
Figure 17:
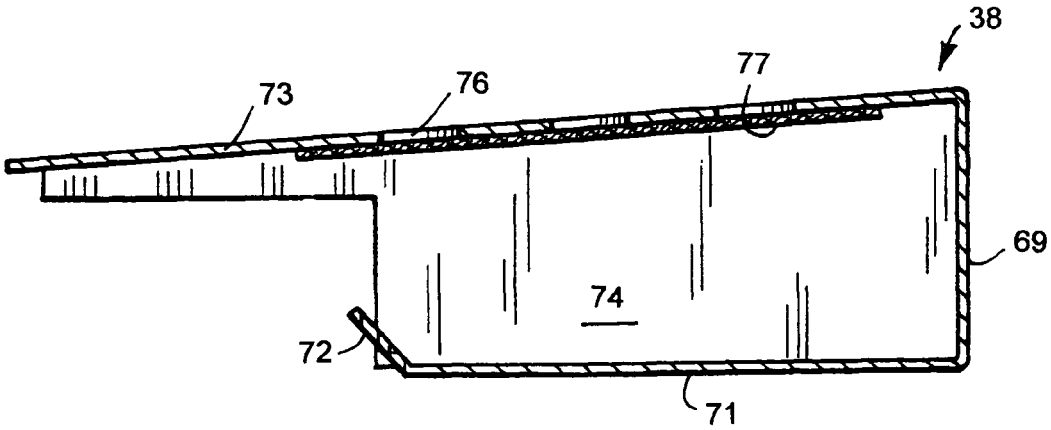
FIG. 17 is a sectional view taken along the line 17-17 of FIG. 11.

As shown in FIGS. 6 and 9, bottom wall 27 has a rectangular opening 39 extended rearwardly from front wall 23. Transverse front wheel roller 17 extends downwardly through opening 39 and engages surface 13. Opposite ends of roller wheel 17 are rotatably mounted with bearings or sleeves on side wall support plates 41 and 42, shown in FIG. 8. A pair of parallel cylindrical brush assemblies 43 and 44 extend transversely across opening 39 in front of roller wheel 17. Opposite ends of brush assemblies 43 and 44 are rotatably mounted with bearings on side plates 41 and 42. As shown in FIG. 8, front brush assembly 43 has a transverse tubular core 46 supporting two rows of helical arranged radial projections 47 and 48. Rear brush assembly 44 has a transverse core 49 supporting two rows of helical arranged radial projections 51 and 52 to receive dirt and debris from front brush assembly 43 and direct the dirt and debris over the roller wheel 17 and into filter box 38.

Brush assemblies 43 and 44 are concurrently rotated in opposite directions with a dc electric motor 53. As shown in FIG. 8, motor 53 is wired to a rechargeable battery 54 and ON-OFF rocker switch 56. A circuit breaker and battery charge port can be wired with motor 53 and battery 54. An endless drive belt 57 transmits power from motor pulley 58 to tooth pulleys 59 and 61 secured to the ends of brush assemblies 43 and 44. Belt 57 is trained around pulley 59 and extends over pulley 61. A tooth idler wheel 62 maintains belt on pulley 61. On operation of motor 53 brush assembly 43 is rotated in a clockwise direction, shown by arrow 63 in FIG. 8, and brush assembly 44 is rotated in a counterclockwise direction, shown by arrow 64. Front brush assembly 43 picks up dirt and debris 12 from surface 13 and sends it upwardly and rearwardly toward rear brush assembly 44. Rear brush assembly 44 picks up additional dirt and debris from surface 13 and directs the dirt and debris over roller wheel 17 into filter box 38 shown by arrow 66 in FIG. 7.

Figure 7:
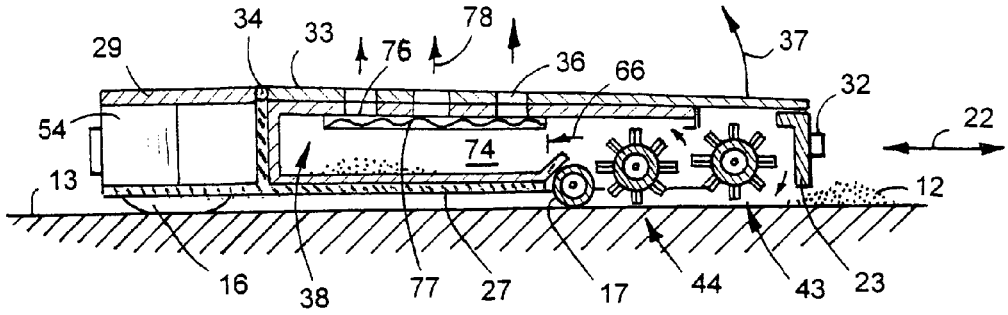
FIG. 7 is a sectional view taken along the line 7-7 of FIG. 5.

Filter box 38, shown in FIGS. 10 to 17, is a dirt and debris collection container that is removable from sweeper 10. Box 38 is made of waterproof materials to accommodate mud, snow, ice and like liquids and semi-liquids in addition to dirt and debris. Box 38 has upright side walls 67 and 68 joined to a rear wall 69, a bottom wall 71 and top wall 73. The front edge of bottom wall 71 has an upwardly and forwardly extended transverse lip 72. Lip 72 is a flat rectangular member. The front of box 38 has an opening to an internal chamber 74 for holding dirt and debris. Top wall 73 has transverse rows of slots or openings 76 to allow air to flow out of chamber 74. The forward section of top wall 73 extends forwardly of the bottom wall 71 and lip 72. A sheet of filter material 77, such as a fiber or plastic member, is attached to the bottom of top wall 73. The filter material 77 covers slots 76 whereby filter material 77 separates dirt and debris from the air flowing through filter material 77 and slots 76. As shown in FIG. 7, slots 36 in cover 33 are aligned with slots 76 in top wall 73 of filter box 38 to allow air to flow to atmosphere shown by arrows 78.

It is understood that the above description is intended to be illustrative, not restrictive. Numerous characteristics and advantages of the cordless sweeper as described herein have been set forth in the foregoing description together with details of its structure and function. The scope of the invention should, therefore, be determined with reference to the appended claims, along with the full scope of equivalents to which such claims are entitled.

The invention claimed is:

1. A sweeper for picking up dirt and debris from a surface comprising:

a frame, rear wheels rotatably connected to said frame, a transverse front roller wheel rotatably connected to said frame, said rear wheels and roller wheel supporting the frame above said surface, front and rear transverse brush assemblies rotatably mounted on the frame, an electric motor, a battery wired to the electric motor to provide electric power to operate said electric motor, a power transmitting mechanism coupling the electric motor to the front and rear brush assemblies operable to rotate the front and rear brush assemblies in opposite rotational directions, a container having a chamber and a front opening open to the chamber supported on the frame rearwardly of the rear brush assembly, said roller wheel being transversely located between the rear brush assembly and below the front opening of the container whereby when the electric motor is operated to rotate the front and rear brush assemblies dirt and debris on the surface are picked up and transferred to the chamber of the container, a cover located over the container to retain the container on the frame, and a connector securing the cover to the frame.

2. The sweeper of claim 1 wherein:

said frame includes upright side walls, and members rotatably supporting opposite ends of the brush assemblies on said side walls.

3. The sweeper of claim 1 wherein:

said frame includes a top wall, and said connector comprising a transverse hinge connecting the cover to the top wall whereby the cover can be pivoted upwardly to provide access to the container and allow the container to be inserted into and removed from the sweeper.

4. The sweeper of claim 3 wherein:

said cover has openings to allow air to flow out of the chamber to atmosphere.

5. The sweeper of claim 1 wherein:

each brush assembly has a transverse cylindrical core, and a pair of helical rows of radial projections attached to the core.

6. The sweeper of claim 1 wherein:

the power transmitting mechanism includes an endless belt and tooth pulleys joined to ends of the front and rear brush assemblies cooperating with the belt to rotate the front and rear brush assemblies in opposite rotational directions.

7. The sweeper of claim 1 including:

an on-off switch wired to the battery and electric motor to control the operation of the electric motor.

8. The sweeper of claim 1 including:

an upright handle, and a member securing the handle to the frame whereby the handle is useable to manually move the sweeper relative to the surface to pickup dirt and debris from the surface.

9. The sweeper of claim 1 wherein:

the container comprises a box having upright side walls, a bottom wall, a rear wall and top wall jointed together to provide said chamber for holding dirt and debris, said box having said front opening between the top and bottom walls to allow dirt and debris to flow with air into the chamber, said bottom wall having a transverse front edge, a transverse lip joined to the front edge of the bottom wall below the front opening, said lip extended upwardly and forwardly from said front edge over the front roller wheel, said roller wheel being located below the lip, said top wall having at least one opening to allow air to flow from the chamber to atmosphere.

10. The sweeper of claim 9 wherein:

said top wall has a plurality of openings, and an air filtering member secured to the top wall extended over said openings to filter dirt and debris from air flowing through the air filtering member and openings to atmosphere.

11. The sweeper of claim 9 wherein:

said lip is a flat member extended upwardly and forwardly in front of the front opening to the chamber.

12. The sweeper of claim 9 wherein:

said top wall has a front section extended forwardly of the bottom wall.

13. The sweeper of claim 1 wherein:

the roller wheel comprises an elongated cylindrical roller having opposite ends rotatably mounted on the frame and transversely located between the rear brush assembly and the front opening of the container.

14. The sweeper of claim 13 wherein:

the container has a bottom wall, and a transverse lip joined to the bottom wall below the front opening, said lip being located adjacent the cylindrical roller whereby on rotation of the rear brush assembly dirt and debris from the surface are directed over the roller and lip into the chamber of the container.

15. A sweeper for picking up dirt and debris from a surface comprising:

a frame, at least one rear wheel rotatably connected to the frame adapted to engage the surface, a front brush assembly rotatably mounted on the frame adapted to engage the surface, a rear brush assembly rotatably mounted on the frame, said rear brush assembly being laterally spaced from and generally parallel to the front brush assembly, a power mechanism drivably connected to the front and rear brush assemblies operable to rotate the front and rear brush assemblies in opposite rotational direction, a container having a chamber and a front opening open to the chamber to accommodate dirt and debris directed into the chamber by the rotation of the front and rear brush assemblies, a roller wheel rotatably mounted on said frame and located between the rear brush assembly and below the front opening to the chamber adapted to engage the surface, and said rear wheel and roller wheel being adapted to support the sweeper on the surface.

16. The sweeper of claim 15 wherein:

the front and rear brush assemblies each includes rows of generally radial projections adapted to engage the surface during rotation of the front and rear brush assemblies to pick up dirt and debris from the surface and direct the dirt and debris into the chamber of the container.

17. The sweeper of claim 15 wherein:

the power mechanism includes an endless belt, pulleys connected to the front and rear brush assemblies, said endless belt being located on said pulleys to rotate the front and rear brush assemblies in opposite rotational directions, an electric motor operably connected to said belt to move the belt thereby rotating the front and rear brush assemblies, and a battery mounted on the frame providing electric power to said electric motor.

18. The sweeper of claim 15 wherein:

the container has a bottom wall, and a transverse lip joined to the bottom wall below the front opening, said lip being located adjacent said roller wheel whereby on rotation of the rear brush assembly dirt and debris from the surface are directed over the roller wheel and lip into the chamber of the container.

19. The sweeper of claim 15 wherein:

the roller wheel comprises an elongated cylindrical roller having opposite ends rotatably mounted on the frame and transversely located between the rear brush assembly and the front opening of the container.

20. The sweeper of claim 19 wherein:

the container has a bottom wall, and a transverse lip joined to the bottom wall below the front opening, said lip being located adjacent the cylindrical roller whereby on rotation of the rear brush assembly dirt and debris from the surface are directed over the roller and lip into the chamber of the container.

* * * * *